United States Patent [19]

Watt et al.

[11] Patent Number: 4,870,768

[45] Date of Patent: Oct. 3, 1989

[54] MOVING PICTURE DEVICE

[76] Inventors: James A. Watt; Stanley A. Watt, both of 5507 Ladbrooke Dr. S.W., Calgary, Alberta, Canada, T3E 5Y1

[21] Appl. No.: 155,137

[22] Filed: Feb. 11, 1988

[51] Int. Cl.[4] ..... G09F 19/00

[52] U.S. Cl. ..... 40/430; 40/454

[58] Field of Search ..... 40/454, 430, 431, 453, 40/440; 272/8 D; 350/167, 106; 352/58, 81

[56] References Cited

U.S. PATENT DOCUMENTS

| | | | |
|---|---|---|---|
| 1,150,374 | 8/1915 | Kanolt | 352/81 |
| 1,475,430 | 11/1923 | Curwen | 40/454 |
| 2,514,814 | 7/1950 | Towne | 350/131 |
| 2,833,176 | 5/1958 | Ossoinak | 352/58 |
| 3,241,429 | 3/1966 | Rice et al. | 350/167 |
| 3,463,581 | 8/1969 | Clay | 352/58 |
| 3,480,352 | 11/1969 | Dennison et al. | 350/167 |
| 3,538,632 | 11/1970 | Anderson | 40/427 |
| 3,586,592 | 6/1971 | Cahn | 428/29 |
| 3,686,781 | 8/1972 | Calhoun, Jr. | 40/454 |
| 3,791,058 | 2/1974 | Mollica | 40/431 |
| 4,034,495 | 7/1977 | Lemelson | 40/453 |

*Primary Examiner*—Robert Peshock
*Assistant Examiner*—Cary E. Stone
*Attorney, Agent, or Firm*—Fleit, Jacobson, Cohn, Price, Holman & Stern

[57] ABSTRACT

A display device is disclosed which comprisees a plurality of positive lenses disposed in a concavely curved lens array as seen by an observer and a plurality of substantially concavely curved pictures respectively associated with the lenses. Each of the pictures is disposed behind the respective lens and is located substantially at or within the focal length of the respective lens. The pictures each comprise a plurality of picture elements such that, when the lens array is viewed from different angles by an observer, the observer is able to perceive a composite image formed from magnified images of the picture elements of different ones of the pictures.

12 Claims, 6 Drawing Sheets

MOVING PICTURE DEVICE

FIELD OF THE INVENTION

The present invention relates to a display device and, more particularly, to a display device comprising a curved array of lenses and associated pictures which, by relative movement between such an array and an observer, can present to the observer a plurality of images, which may be identical or which may vary for the purpose, for example, of giving the appearance of a moving picture.

BACKGROUND OF THE INVENTION

Various display devices have, in the past, been proposed for providing an observer with an image which changes in dependence on the relative position of the observer and the display device. For example, U.S. Pat. No. 3,241,429, issued Mar. 22, 1966 to H. D. Rice et al., relates to a pictorial parallax panoramagram unit which comprises a lineated image layer and a lenticular screen fixed directly over the lineated image layer. The lenticular screen comprises a series of semi-cylindrical or partially cylindrical curves forming the forward faces of elongate lens elements which have planar rear faces. On the image layer, and corresponding to each of the lens elements, there are provided two different panels which, in combination, form two separate images, which are successive images of a scene so as to provide the impression of movement when the display panel is viewed from different angles. Since this display device is of a generally planar shape, there is no suggestion of effecting relative rotation of the display device and the observer in such a manner as to be able to present, for example, a cyclically varying sequence of images nor is there any suggestion that the device may be viewed from any location about the device.

In U.S. Pat. No. 3,586,592, issued June 22, 1971 to L. Cahn, there are described various display devices intended to provide a three dimensional picture by enabling the viewer to simultaneously view different picture elements, but again there is no suggestion of a relatively rotatable arrangement of the display device and the observer.

Other display devices are disclosed in U.S. Pat. Nos. 2,514,814, issued July 11, 1950 to G. Towne; 3,686,781, issued Aug. 21, 1972 to Hugh C. Calhoun, Jr.; 3,538,632, issued Nov. 10, 1970 to K. Anderson and 4,034,495, issued July 12, 1977 to Jerome H. Lemelson.

BRIEF SUMMARY OF THE INVENTION

It is an object of the present invention to provide a novel and improved display device in which an array of lenses is arranged, in association with a plurality of picture elements, so as to facilitate rotation of the display device relative to an observer in order to present to the observer a sequence of different images which may, if required, vary cyclically.

More particularly, the present invention provides a display device comprising a plurality of positive lenses disposed in an outwardly curved lens array, a plurality of concavely curved pictures respectively associated with the lenses, the pictures each being disposed behind the respective lens and being located substantially at or within the focal length of the respective lens, and the pictures each comprising a plurality of picture elements such that, when the lens array is viewed from different angles by an observer, the observer is able to perceive a composite image formed from magnified images of the picture elements of different ones of the pictures.

Preferably, the array of the lenses is a cylindrical array which, in a preferred embodiment of the invention, is rotatable together with the pictures about the longitudinal axis of the cylindrical array, so as to provide the observer, external of the array with a sequence of images which changes in a cyclical or repetitious manner to give the impression of a moving picture or to present successive different images to the observer. Alternatively the curved array of lenses is a spherical array.

BRIEF DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENTS

Figure 1:
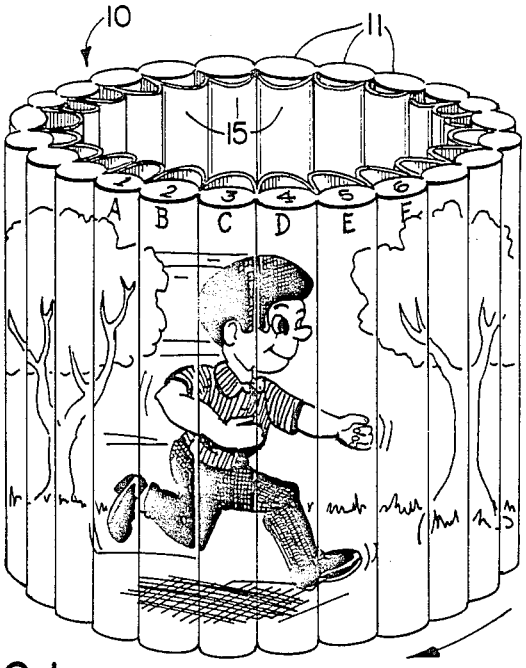
FIG. 1 shows a view in perspective of a display device embodying the present invention.

The device of FIG. 1, which is indicated generally by reference numeral 10, has a plurality of elongate, cylindrical curved lenses 11. These are shown in a preferred form, in which they are transversely curved convexly on both inner and outer surfaces and touch or nearly touch each other along their vertical edges.

The lenses 11 are arranged in a cylindrical array, with the longitudinal axis of each lens parallel to and equidistant from the vertical axis (not shown) of the cylindrical array, and with the optical axis of each lens passing through the axis of the cylindrical array.

The lenses 11 are conveniently molded of transparent plastic material.

Within the cylindrical array of elongate lenses 11, there are provided a plurality of transversely concavely curved, elongate pictures indicated by reference numeral 15, each picture 15 being associated with a respective one of the lenses 11 and each having its substantially concave surface 16 (FIG. 2) facing outwardly of the cylindrical array of lenses 11.

The cylindrical device 10, comprising lenses 11 and the associated pictures 15, is rotatable about its vertical axis.

Figure 2:
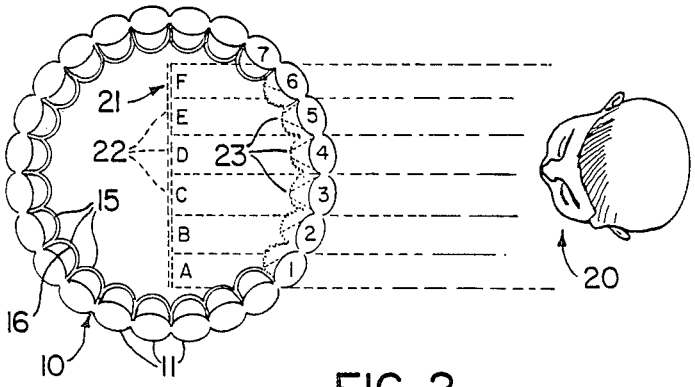
FIG. 2 shows a plan view of the display device of FIG. 1.

Referring now to FIG. 2 of the drawings, which for convenience shows the observer 20 much closer to the display device 10 than would be normal during the operation of the display device, it will be apparent that, with the cylindrical array in the position of rotation in which it is shown in FIG. 2, the observer 20 views a composite image 21, which is made up of a plurality of discrete image elements 22 (which are indicated by respective reference characters A,B,C . . . through F), each being a magnified image of a corresponding picture portion 23 (which are indicated by respective reference characters a,b,c . . . through f) of the pictures 15. Due to the nature of the cylindrical lenses, the picture portions 23 are elongate, strip-like portions of the pictures 15, their width being determined by the angles of view and by the focal length of the lenses 11.

It will be apparent that, following a snall additional rotation of the device 10, the observer 20 will observe different discrete image elements of different corresponding picture elements.

More particularly, lenses facing the observer 20 have been indicated, together with their associated pictures by reference numerals 1, 2, 3 . . . through 7. The observer 20, who as previously mentioned is shown closer than would normally be the case, sees only portions 23 of these pictures, these portions being elongate strips or picture elements a, b, c . . . through f (FIG. 3), which are each magnified in the horizontal dimension to fill the width of the corresponding lens, and thus to produce corresponding image elements A,B,C,D,E and F that combine together to form the composite image 21 in the plane of the vertical axis of rotation of the device. With a preferred distance between lens and picture, to be described later, this image will appear to remain still as the device rotates, with the lenses seeming to sweep over it. But when the device has advanced one lens-width, the image A-B-C-D-E-F will then be made up of a new set of picture elements a, b, c, . . . through f.

Figure 3:
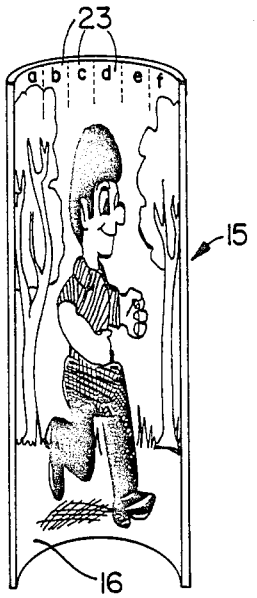
FIG. 3 shows a view in perspective of a picture forming part of the display device of FIG. 1.

If each picture 15 is identical, a steady image A-B-C-D-E-F will be seen from all sides, irrespective of how the device is rotated. The pictures 15 will normally be shrunk in the horizontal dimension by a factor related to the magnification of the cylindrical lenses, as seen in FIG. 3, so that the magnified images will have normal proportions. The picture elements a, b, c . . . through f will blend smoothly into a recognizable, though elongated picture.

If however, each new set of picture elements a, b, c . . . through f represents a different picture, the image will change correspondingly as the device is rotated.

If these pictures form an animated sequence, the image will be a motion picture with as many "frames" of action as there are lenses 11 and corresponding pictures 15. If the animation is smooth, with little difference between the frames, each individual picture 16 as shown in FIG. 3 will appear to be fairly continuous, with pictures elements a and b representing the left, picture elements c and d the middle and picture elements e and f the right of the overall image, respectively.

If the animation has sudden changes, there will be discontinuities in the individual pictures, as picture element c of each picture 15 is seen one frame ahead of picture element b, and two frames ahead of picture element a.

Furthermore, it will also be apparent that, after one complete rotation of the cylindrical array about the vertical axis thereof, the sequence of images thus produced will be repeated, and that such repetition will recur, in a cyclical manner, after each rotation of the cylindrical array.

Furthermore, as will be apparent from FIGS. 1 and 2, the image or scene which is perceived by the observer 20 appears across almost the entire width of the cylindrical array.

Figure 4:
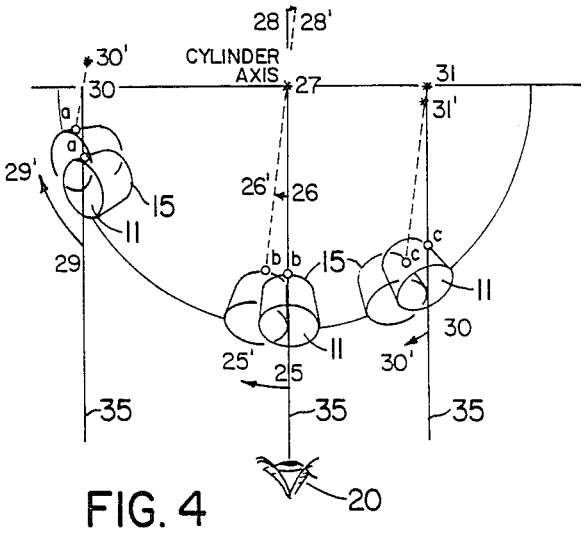
FIG. 4 shows a diagrammatic plan view of three of the lenses of the device of FIG. 1 in each of two positions.

A preferred distance between lens and picture at which the image appears to remain still as the device 10 is rotated was mentioned previously. Referring now to FIG. 4, a diagrammatic plan view of three lenses 25, 29 and 30, (with corresponding pictures 15) in two positions each, is shown. As each lens moves to the left through a distance equal to a half-lens-width, the lens-picture combination also rotates slightly. As the lens 25 moves to the position indicated by reference numeral 25', three things can happen to the image of picture element b. If the image appears in front of the axis of the cylinder 27, it will move slightly in the direction of rotation to 26'. If the image lies behind the cylinder axis 27, as indicated by reference numeral 28, the image will move in a direction opposite to the rotation of the device, to the position indicated by reference numeral 28'. But if the image lies on the plane through cylinder axis 27, perpendicular to the line of sight 35 from the observer 20, the image will not move as the lens moves from 25 to 25'. Picture element b, which was seen through the centre of the lens in position 25, will now be seen at the edge of the lens at position 25' due to the rotation of the lens as it revolves around the cylinder axis 27.

Further from the centre of the cylinder as seen by observer 20, a lens at position 30 moves to position 30'. If the image of picture element c appears at 31 on the plane through the cylinder axis 27 mentioned previously, the movement of the lens-picture combination from 30 to 30' will cause the image to move from 31 to 31', still appearing to remain still to the observer 20, though moving slightly towards him. Similarly, at the extreme opposite edge of the cylinder as seen by observer 20, if the image 30 of picture element a is on this same plane through cylinder axis 27 perpendicular to visual axis 35, movement of a lens from 29 to 29' will cause movement of the image from 30 to 30', away from the observer but with little lateral displacement.

With this preferred arrangement, a steady image appears with the lenses seeming to sweep across it. Alternatively, if a person walks around the device, the image will appear to follow him. Each person standing around the device will see the image as if facing that particular person. Furthermore, the picture element seen through each lens will be distinct, the sum of the picture elements forming a continuous picture 15 as seen in FIG. 3. The sum of the image elements form a continuous, steady image across nearly the entire visible surface of the cylinder, appearing behind the lenses as a flat picture at the level of the cylinder axis, facing the observer from whatever position he views it.

Figure 5:
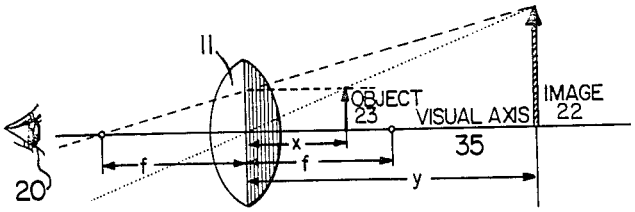
FIG. 5 shows a diagrammatic plan view of one lens of the device in FIG. 1 showing preferred object and image distances.

It is possible to calculate this preferred distance from lens 11 to its respective picture 15, such that the image lies in the plane through the cylinder axis 27. Referring now to FIG. 5, which shows a ray-diagram of a lens 11 with focal length f and its associated picture element (the object) at distance x. The distance y from the centre of the lens to image element 22 may be calculated by the formula:

$$x=fy/(f+y)$$

For lenses in positions 25 and 25' of FIG. 4, y=the radius r of the cylindrical device:

$$x=fr/(f+r)$$

Figure 6:
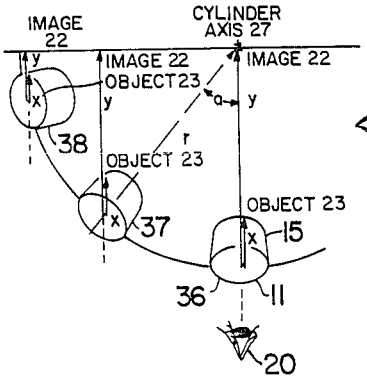
FIG. 6 shows a diagrammatic plan view of one lens of the device in FIG. 1 showing the preferred curvature of the picture backing the lens.
Figure 6:
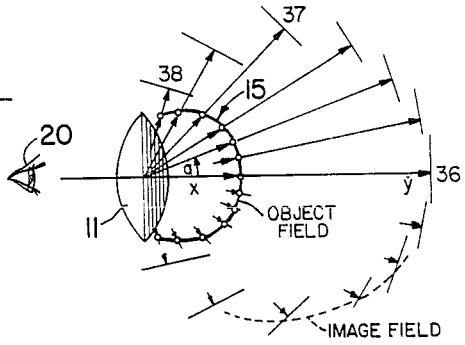

This is a convenient formula for calculating the distance of the picture 15 behind the lens 11. Knowing the focal length of the lens, it is possible to calculate the ideal shape of the concavely curved picture 15 behind each lens 11. FIG. 6 shows how object distance x changes to keep image distance y such that the image is in the plane through cylinder axis 27 perpendicular to the line of sight of observer 20, who as usual is shown much closer than would actually be the case. On the left in FIG. 6 is a diagrammatic plan view of the device with lens 11 in three positions, as indicated by reference numerals 36, 37 and 38. As the lens rotates from position 36 to position 38, it approaches the plane through the cylinder axis 27, and both distances x and y decrease. With the radius of the cylindrical array again represented by r, and the angle of the lens 11 from the optical axis represented by a:

$$y=r \text{ cosine } a$$

The right side of FIG. 6 shows a diagrammatic plan view of lens 11 as if it were fixed and the observer 20 were rotating around it. Values of the image distance y are shown, forming a curved image field. Values of the corresponding object distances x have been calculated by the formula derived from FIG. 5:

$$x=\frac{fy}{f+y}$$

$$x=\frac{f\,r\cos a}{f+r\cos a}$$

It may be seen that the curved object field, the ideal curvature for picture 15, is very close to the shape that a simple loop of flexible material would assume if attached to the edges of the lens 11.

This ideal curve depends on the focal length of the lenses and the radius of the cylindrical array. The width of the lens, and therefore the number of lenses possible around the circumference, will be related to this curve, although practical constraints and the use of thick lenses require departures from the ideal.

Figure 7:
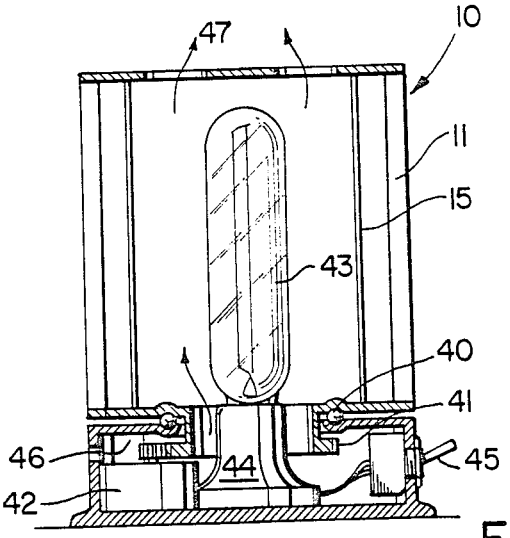
FIG. 7 shows a view in cross-section through an illuminated table model of the device of FIG. 1.

FIG. 7 shows a diagrammatic cross-section of a table-top display device. The device 10 shown previously, with lenses 11 and pictures 15, is supported on a bearing 40 and driven by a motor 42 by friction, belt or gear connection to an appropriate rim 41. An electric light bulb 43 which is preferably elongate, illuminates, i.e. backlights, the device 11 from within as the motor rotates the device. A holder 44 for the light bulb is enclosed within the diameter of the bearing, which can be wide or narrow depending on whether the lamp base or merely a slender tube supporting the lamp base and containing the electrical supply to the bulb is so enclosed. An electrical switch 45 is provided, as are air-holes 46 and 47 for adequate ventilation of the lamp. This table-top device may be utilized to provide a novelty nightlight for children. Alternatively, it may be modified so as to run on a clockwork motor without a light, or as part of a music box.

Figure 8:
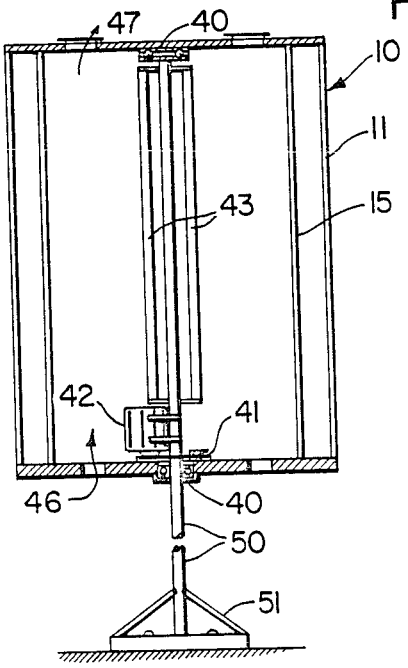
FIG. 8 shows a view in cross-section through an illuminated outdoor sign using a large version of the device of FIG. 1.

FIG. 8 illustrates, in diagrammatic cross-section, a large display device in the form of a rotating sign. The device 10 is similar in design to others shown but the lenses 11 in this embodiment may be of the thin fresnel variety and may be either flat or curved in shape. The picture 15 is of translucent plastic material and is illuminated, i.e. backlit, from within by a plurality of lamps 43, preferably of the fluorescent tube variety, fixed to a centre pole 50 about which the device rotates. The device is supported on top and bottom bearings 40 and is powered by a motor 42 fixed to the supporting pole 50 and connected with the device by gear, friction, chain or belt drive such that it will disconnect in high winds to avoid damage. The centre pole is supported in turn on a sturdy base 51.

Figure 9:
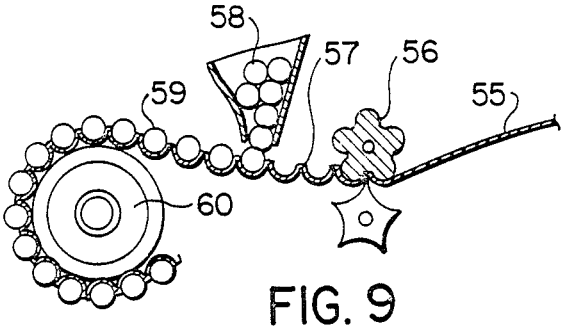
FIG. 9 shows a method of manufacturing a small version of the device of FIG. 1 using plastic rods as lenses.
Figure 10:
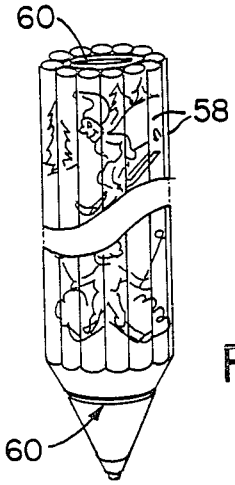
FIG. 10 shows a small novelty pen using the design of the device of FIG. 1 and the materials of FIG. 9.

FIG. 9 shows, in very diagrammatic manner, how a continuous sheet of paper or similar material 55 may be pleated by mechanical means 56, producing pleats 57 between which plastic or glass rods 58 may be fixed to produce a belt of lens-picture elements 59. This belt may be cut to length and rolled around a pen or mechanical pencil 60 to produce a novelty pen or pencil as shown in FIG. 10. Turning the pen allows an animation printed on the pleated backing to be seen. The animation may appear to travel down the long, slender device, passing through a number of cycles as it does so.

Figure 11:
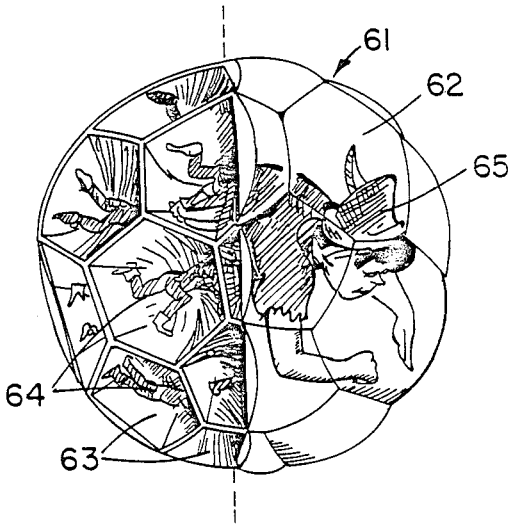
FIG. 11 shows a spherical design of the device of FIG. 1, with and without lenses.

FIG. 11 shows a substantially spherical device in the form of a novelty ball 61, with lenses 62, some of which are removed from the left-hand side of the device to show the pictures backing the lenses. The lenses 62 are spherical rather than cylindrical, and the pictures 64 are in cup-shaped cells 63 behind the lenses, producing together the image 65. To cover the surface of the spherical device, these cells and their corresponding lenses have a generally hexagonal or pentagonal periphery. The lenses may be molded together as a hemispherical shell, two hemispherical shells being assembled to form a ball around the picture cells, which may be similarly molded in one or several pieces. Alternatively, the pictures may be printed in the flat on thin plastic, which could then be vacuum-molded over a suitable form to produce the cells.

Figure 12:
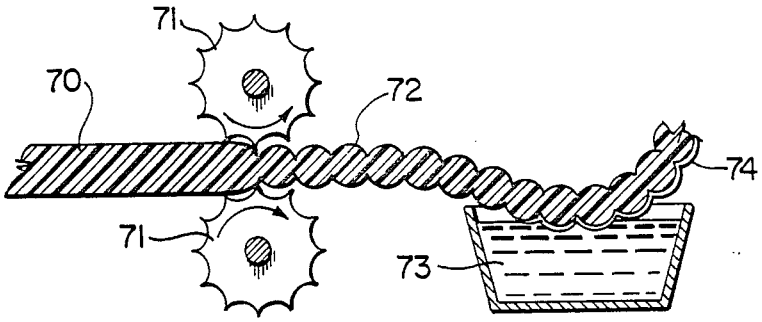
FIG. 12 shows a method of producing a continuous photographic film based on the design of FIG. 1

FIG. 12 illustrates in a very diagrammatic fashion how lenses 72 can be embossed in miniature by a suitable device 71 in a transparent film base 70. Dipping the resulting lenticular base in a photographic emulsion 73 produces a light-sensitive backing 74. A cylinder of this material may have its pictures printed by photographic techniques.

Figure 13:
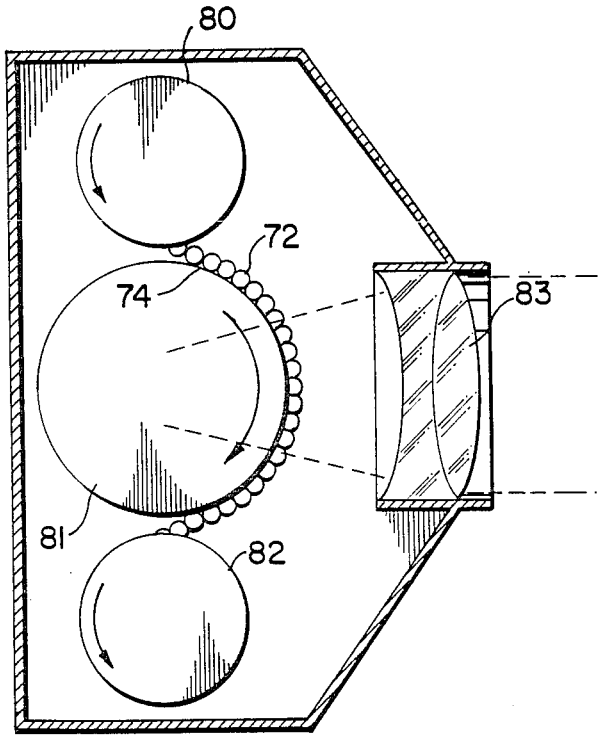
FIG. 13 shows a movie camera using the film of FIG. 12 after the design of the device of FIG. 1.

Alternatively, as shown in FIG. 13, a continuous roll of this sort of film fed from a film reel 80 over a cylindrical picture drum 81 and into a take-up reel 82 may form a moving-picture camera. The film has a lens surface 72 facing a photographic lens 83, which would be focussed onto the image plane of the lenticular film (generally at the centre of curvature of drum 81). Exposure would be controlled by the aperture of the photographic lens and the rate at which the film is driven. Development of the film is by standard methods. The moving picture so recorded may be observed as the developed film is passed over a cylinder of the same diameter as that in the camera, with no other viewing device being needed.

This type of movie camera, with a continuously moving film and no shutter, would work well in high-speed photography.

We claim:

1. A display device, comprising:

a plurality of positive lenses disposed in an outwardly curved lens array as seen by an observer;

a plurality of substantially concavely curved pictures respectively associated with said lenses;

said pictures each being disposed behind the respective lens and being located substantially at or within the focal length of the respective lens;

said pictures each comprising a plurality of picture elements such that, when said lens array is viewed from different angles by an observer, the observer is able to perceive a composite substantially planar image formed from magnified images of the picture elements of different ones of said pictures.

2. A display device as claimed in claim 1, wherein the lens array is cylindrical and means are provided for supporting the lens array for rotation about the longitudinal axis of the array.

3. A display device as claimed in claim 2, further comprising drive means for effecting the rotation of the array about the array longitudinal axis.

4. A display device as claimed in claim 2, wherein said pictures are translucent and a light source is provided within said array for backlighting said pictures.

5. A display device as claimed in claim 1, wherein said image elements are elements of successive images of a moving picture display, which is perceived by the observer by relative movement of the array and the observer.

6. A display device as claimed in claim 1, wherein the lens array is a substantially cylindrical array in which said pictures are enclosed by said lenses.

7. A display device, comprising:

a plurality of positive lenses disposed in a curved lens array;

a plurality of curved pictures respectively associated with said lenses;

said pictures each being disposed behind the respective lens and being disposed behind the respective lens and being located substantially at or within the focal length of the respective lens;

said pictures each comprising a plurality of picture elements such that, when said lens array is viewed from different angles by an observer, the observer is able to perceive a composite image formed from magnified images of the picture elements of different ones of said pictures, wherein the lens array is cylindrical and each of said pictures is formed on a concavely curved picture surface which at least substantially coincides with an ideal curved object field defined by the equation:

$$x = \frac{fr \cos a}{f + r \cos a}$$

wherein a=the angle from the visual axis, x=the distance of the object field from the centre of said lens, f=the focal length of said lens and r=the radius of the cylindrical array.

8. A display device, comprising:

a plurality of elongate positive lenses arranged in mutually parallel relationship in a cylindrical array;

said lenses each having a transversely convexly curved outer surface;

a plurality of elongate, transversely concavely curved pictures disposed within said cylindrical array and respectively associated with said lenses;

each said picture being located at least substantially at or within the focal length of the respective lens and having a transversely concavely curved picture surface facing outwardly of the cylindrical array;

said concavely curved picture surfaces of said pictures each comprising a plurality of picture elements such that, when said lens array is viewed from different angles by an observer, the observer is able to perceive a substantially planar composite image formed from magnified images of the picture elements of different ones of said pictures.

9. A display device as claimed in claim 8, wherein the lens array is cylindrical and means are provided for supporting the lens array for rotation about the longitudinal axis of the array.

10. A display device as claimed in claim 9, wherein drive means for effecting the rotation of the array about the array longitudinal axis.

11. A display device as claimed in claim 9, wherein said pictures are translucent and a light source is provided within said array for backlighting said pictures.

12. A display device, comprising:

a plurality of elongate positive lenses arranged in mutually parallel relationship in a cylindrical array;

said lenses each having a transversely convexly curved outer surface;

a plurality of elongate, transversely concavely curved pictures disposed within said cylindrical array and respectively associated with said lenses;

each said picture being located at least substantially at or within the focal length of the respective lens and having a transversely concavely curved picture surface facing outwardly of the cylindrical array;

said concavely curved picture surfaces of said pictures each comprising a plurality of picture elements such that, when said lens array is viewed from different angles by an observer, the observer is able to perceive a composite image formed from magnified images of the picture elements of different ones of said pictures each of said pictures being formed on a concavely curved picture surface which at least substantially coincides with an ideal curved object field defined by the equation:

$$x = \frac{fr \cos a}{f + r \cos a}$$

wherein a=the angle from the visual axis, x=the distance of the object field from the centre of said lens, f=the focal length of said lens and r=the radius of the cylindrical array.

* * * * *